United States Patent [19]

Babcock et al.

[11] Patent Number: 4,673,484

[45] Date of Patent: Jun. 16, 1987

[54] AMPHIPHILIC PHASE BEHAVIOR SEPARATION OF CARBOXYLIC ACIDS/HYDROCARBON MIXTURES IN RECOVERY OF OIL FROM TAR SANDS OR THE LIKE

[75] Inventors: Robert E. Babcock, Fayetteville, Ark.; W. Hardey Beaver; F. Dianne Wood, both of Baton Rouge, La.

[73] Assignee: Diversified Petroleum Recovery, Inc., Little Rock, Ark.

[21] Appl. No.: 932,688

[22] Filed: Nov. 19, 1986

[51] Int. Cl.[4] ..... E21B 43/40

[52] U.S. Cl. ..... 208/435; 208/390; 208/391; 166/273

[58] Field of Search ..... 260/397.25; 208/390, 208/391, 435; 166/273, 274

[56] References Cited

U.S. PATENT DOCUMENTS

| | | | |
|---|---|---|---|
| 3,006,411 | 10/1961 | Holbrook | 166/273 |
| 3,373,809 | 3/1968 | Cooke, Jr. | 166/273 |
| 3,691,211 | 9/1972 | Julian | 260/397.25 |
| 4,192,651 | 3/1980 | Keller | 208/435 X |
| 4,213,500 | 7/1980 | Cardenas et al. | 166/273 |
| 4,222,849 | 9/1980 | Shimizu | 208/435 |
| 4,311,561 | 1/1982 | Hastings | 196/14.52 |
| 4,338,185 | 7/1982 | Noelle | 208/391 |
| 4,388,170 | 6/1983 | Schmid et al. | 208/435 X |
| 4,480,691 | 11/1984 | Herter et al. | 166/267 |
| 4,572,292 | 2/1986 | Stapp | 166/273 X |

OTHER PUBLICATIONS

Buford D. Smith "Design of Equilibrium Stage Processes" Published 1963 by McGraw Hill; pp. 406–409.

*Primary Examiner*—John Doll
*Assistant Examiner*—Glenn A. Caldarole
*Attorney, Agent, or Firm*—Robert R. Keegan

[57] ABSTRACT

There is disclosed a process of oil recovery from tar sands or separation of hydrocarbons from a solid or viscous bitumen source wherein carboxylic acids or carboxylic acid mixtures are utilized as a solvent or diluent and are mixed with heavy crude oil, injected into an oil reservoir or mixed with tar sands in a surface vessel to reduce the viscosity of the crude oil and to increase the mobility of the oil. The process is characterized by the use of an amphiphilic phase separation induced by injection of isopropanol or other alcohol to facilitate the recovery of carboxylic acid diluent from the bitumen product, and another phase separation step may be employed to separate the carboxylic acid component from the alcohol. Sodium chloride or other brine solution is usually mixed with the alcohol and many embodiments combine a light hydrocarbon such as heptane with the carboxylic acid as an additional solvent. Carboxylic acids in the form of fatty acids with from 8 to 20 carbon atoms are preferred. Distillation may be employed to separate the alcohol from the brine solution or to concentrate the alcohol for recycling. All the processing chemicals may be recycled in the process with the exception of the light hydrocarbons, which may or may not be separated from the product stream in later conventional processing.

41 Claims, 3 Drawing Figures

AMPHIPHILIC PHASE BEHAVIOR SEPARATION OF CARBOXYLIC ACIDS/HYDROCARBON MIXTURES IN RECOVERY OF OIL FROM TAR SANDS OR THE LIKE

The present invention relates primarily to heavy oil and bitumen recovery systems using carboxylic acids, (and in most cases also light hydrocarbons) as extraction solvents for recovering the oil or bitumen components and is particularly characterized by the efficient recovery of the carboxylic acid components for recycle purposes. The molecules of selected acids used will normally contain from 8 to 20 carbon atoms. This recovery is accomplished by a low-energy, alcohol-induced amphiphilic phase separation procedure. It also may find application in fractionating light hydrocarbon components from heavy hydrocarbon components in the oil or bitumen. For reasons of economy, carboxylic acids within the group known as fatty acids will generally be employed; fatty acids is a term given to monobasic aliphatic carboxylic acids.

There are two basic approaches to recovering heavy oil or bitumen. The tar sand resource may be mined and transported to a process plant where the bitumen is extracted using solvents, or the separation may be accomplished in situ. In situ processes have a great deal in common with secondary or enhanced recovery of conventional lighter crude oil.

Conventional light crude oil is produced from the oil-bearing formations by drilling wells down into the formation. The oil usually is driven from the formation into the wells (production wells) by energy stored in the formation, such as the pressure of natural gas. When this natural energy of the formation is expended or, as in the case of most tar sands if it never was present, then energy must be injected into the formation (via injection wells) in order to stimulate production. A third essential element for a successful in situ process is a means of communication between the injection wells and the production wells.

In the case of heavy oil tar sand in situ production, solvating chemical agents and/or steam are often used as the injection fluid in the injection wells. Hydraulic fracturing techniques are usually used to generate communication between injection and production wells. The solvating agent normally would be an admixture of either a light hydrocarbon diluent, an emulsifying agent with water, or in the case of the present invention a carboxylic acid admixture which may also include a light hydrocarbon.

The alternative to an in situ processing scheme is to mine the tar sands, transport them from their place in the formation to a processing plant, extract the bitumen value, and dispose of the waste sand. The emphasis in the following description is on the mined tar sands approach, but in situ processing is not excluded.

Shaft mining of tar sands is considered impractical because of economic considerations, but could theoretically be employed. There are two approaches to the open pit mining of tar sands. The first is to use a few mining units of custom design, which will necessarily be very expensive. For instance, large units which have been considered are bucket wheel excavators, dredges (both hydraulic and bucket ladder) and super-sized draglines. The other approach is to use a multiplicity of smaller mining units of conventional design and relatively much lower unit costs. For example, scrapers and truck-and-shovel operations may be considered. Each method has advantages for particular situations.

The solvent extraction processes used in conjunction with surface-mined tar sand operations vary primarily with respect to contacting device used to extract the solvated bitumen from the sand particles and with respect to the means of recovery of the solvating agent for recycle purposes. The traditional method for separation of solvent from crude oil is distillation which is energy intensive and often renders a process economically and ecologically unattractive. Losses of solvent associated with the spent sand may also decrease the economic feasibility of the process. The present invention contemplates the use of amphiphilic phase behavior to bring about a low energy requirement for recovery of the solvent and may utilize a water enhanced washing scheme in order to minimize solvent losses to the spent sand.

In U.S. Pat. No. 4,480,691 entitled "Recycled Fatty Acid Crude Petroleum Recovery Process" issued to Herter et al. on Nov. 6, 1984, there is described a method of recovering crude oil from materials such as tar sands, kerogen or the like wherein the crude oil source is treated with a fatty acid to produce a solvated crude oil mixture of reduced viscosity. The fatty acid in this mixture is then saponified by reacting it with an aqueous base such as an alkali metal hydroxide to separate the solvated mixture into petroleum crude and an acid soap which will migrate into the aqueous phase. The petroleum crude is separated from the aqueous soap solution and subsequently the fatty acid is recovered by a desaponification step which is conducted in the presence of an acid. Carbonic acid can be generated for the desaponifying step by injecting high pressure carbon dioxide with the desaponification treating vessel. Additional refining can take place by other separation or filtration steps.

In that Herter process, the efficiency of recovery of the fatty acid solvent for further use represents a prime economic consideration. However, it has been found fhat as a result of emulsification in the saponification portion of the process, the economic practicality of solvent recovery used in the Herter process is limited. There has been some progress to improve the Herter process by reducing or eliminating emulsification in the saponification step.

Although there have been numerous prior application of carboxylic acids and especially fatty acids in enhanced oil recovery, these applications use the fatty acid salts or soaps and their derivatives as surfactants, while the Herter process and related processes use a free carboxylic acid as a solvating chemical agent.

An economically important portion of the Herter process and tar sand processes generally concerns the recovery of fatty acid or other solvent from the solvated hydrocarbon mixture.

Fatty acids tend to form azeotropes with most desired petroleum fractions, making the refining of crude oil containing fatty acids much more difficult. Separation of fatty acids from such a mixture by a method other than distillation is thus highly desirable. The approach used in Herter and related processes is saponification of the solvated mixture with an aqueous base, followed by migration of the resulting soap into the aqueous phase, and then desaponification of the aqueous phase to regenerate the fatty acid.

The present invention is an improvement (over the Herter and related processes) utilizing amphiphilic phase behavior for carboxylic acid recovery and thereby eliminating the need for both the saponification and desaponification steps of the Herter process. The present invention may be applicable to separations of carboxylic acids and hydrocarbon mixtures in the fractionations of heavy oil or bitumen into asphaltene and malthene components. When the bitumen or oil feed material is other than tar sand, the invention may be used in cleaning up oil spills, reducing the viscosity of heavy oil or bitumen for transportation by pipeline, the reclaiming of used oil, and the recovery of surfactants from oil admixtures.

Prior patents in other technologies such as Donald V. Julian, U.S. Pat. No. 3,691,211, Sept. 2, 1972, to Procter & Gamble Co. have suggested phase separation to recover acid process material for recycling, but the actual process employed has no applicability to crude oil recovery processes as provided by the present invention.

The present invention makes use of carboxylic acids (with 8 to 20 carbon atoms) or carboxylic acid mixtures as a solvent or diluent which is mixed with an oil, injected into an oil reservoir, or mixed with tar sands in a surface vessel to reduce the viscosity of the crude oil and to increase the mobility of the oil. This feature is also found in the Herter process. However, the present invention differs in its unique process for recovery of carboxylic acid diluent by amphiphilic phase separation induced by alcohol injection whereas Herter et al proposed the separation of fatty acid from a petroleum mixture by saponification of the solvated mixture with an aqueous base, followed by migration of the resulting soap into the aqueous phase, and then desaponification of the aqueous phase to regenerate the fatty acid. Specifically, the present invention contemplates using a lower alcohol containing from 1 to 8 carbon atoms as an amphiphilic cosolvent with the carboxylic acids and preferably employs isopropanol or n-butanol for this purpose. An aqueous brine solution may also be used to enhance the amphiphilic phase separations. Acids used in accordance with the present, invention are usually straight chain carboxylic acids containing between 8 and 18 carbon atoms. The invention may alternatively make use of naturally occurring saturated carboxylic acids with carbon chain lengths between 12 and 20, as well as unsaturated carboxylic acids with a carbon chain length of up to 20 atoms. These unsaturated acids have lower melting points than the corresponding saturated acids and remain liquids at lower temperatures than the saturated fatty acids, making them attractive for use in the process. Three common unsaturated fatty acids which can be used in connection with the present invention are oleic acid, linoleic acid, and linolenic acid. Mixtures of fatty acids or acids containing impurities such as rosin acids can also be employed. It is contemplated that a combination of the present invention and a Herter acid regeneration process arranged in series could prove advantageous. The present invention would bring about a rough cut of the separation of carboxylic acids from the many hydrocarbons and the Herter process would accomplish a higher purity separation when this is desired.

After the carboxylic acid components are separated from the bitumen-derived components according to the present process there is still a need to individually separate the acid components and the alcohol-water components for recycling purposes.

The alcohol-water and acid components may be separated in a straightforward manner by distillation techniques. Such conventional techniques are suitable for this separation process because, unlike the separation of the carboxylic acid and bitumen product, separation of the alcohol and water from the carboxylic acids is not difficult or especially energy intensive; thus with conventional energy conservation procedures such distillation can be cost effective.

According to the invention a different separation procedure may be employed to achieve better economy in some cases. This involves mixing process water with the carboxylic acid and alcohol admixture to achieve water overdosing which shifts the phase equilibrium and allows gravity separation of the carboxylic acids component. Following this step, only very simple and efficient distillation methods may be used to separate the alcohol from its water or brine diluent. Alcohol does not need to be obtained in a pure form from this process and may contain significant amounts of water because the process input normal alcohol-water composition is below the azeotrope composition. This significantly reduces the energy requirements of the alcohol concentrating step.

In addition to providing the above described features and advantages it is an object of the present invention to provide a process for separation of carboxylic acid admixtures from hydrocarbons useful in processes such as the recovery of oil from tar sands or the like wherein an admixture of carboxylic acid usually also containing light hydrocarbons such as heptane is combined with a bitumen source as an extraction solvent after which amphiphilic phase behavior separation of the carboxylic acid component is achieved by introducing an alcohol-water or alcohol brine solution into the mixture.

It is another object of the present invention to carry out the above process utilizing carboxylic acids having 8 to 20 carbon atoms and to gravity separate the carboxylic acid and alcohol-water component for recovery of the acid and alcohol components for recycling use.

It is still another object of the present invention to provide a process as described above wherein separation of the carboxylic acids is achieved in part by water overdosing the admixture resulting from the process and thereafter gravity separating the carboxylic acid from the alcohol-water component.

Other objects and advantages of the invention will be apparent from consideration of the following description in conjunction with the appended drawings in which.

Figure 1:
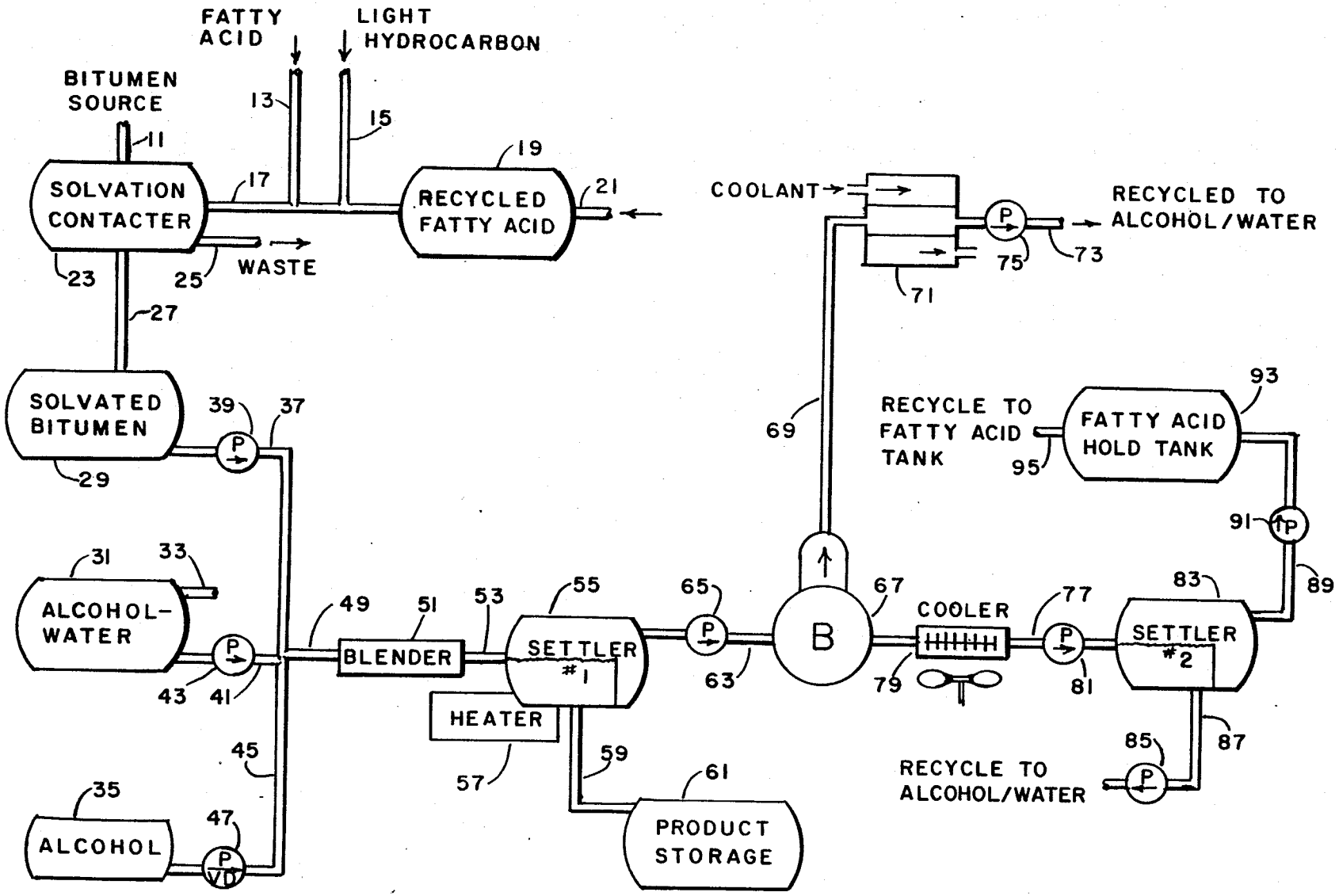
FIG. 1 is a schematic diagram showing apparatus and process employed to carry out the methods according to the present invention.

Referring now to the drawings, FIG. 1 shows a basic preferred process and apparatus therefor according to the invention. Bitumen source material is input through a channel 11 suitable for the solid or semi-solid tar sands or other bitumen source material. Solvent input 17 is connected to lines 13 and 15 for input of fatty acid and light hydrocarbon solvents. A holding tank 19 for recycled fatty acid also feeds the solvent input 17. Line 21 supplies recycled fatty acid to holding tank 19 from a source later to be described.

A solvation contactor 23 of known construction is provided to receive bitumen source material through channel 11 and solvent liquid through line 17. Solvation contactor apparatus of suitable form is shown in U.S. Pat. No. 4,311,561 dated Jan. 19, 1982, to Larry W. Hastings entitled "Apparatus for Extracting Bitumen from Tar Sand." Other apparatus for contacting tar sand or other bitumen source with solvent to efficiently produce solvated bitumen is referred to in the above patent. Solid waste from the solvation contactor 23 exits through channel 25. In some cases the sand from solvation contactor 23 may be washed or otherwise processed and usefully employed in the production of glass or as a raw material in some other manufacturing process. Treatment of the waste from the solvation contactor 25 does not, however, form a part of the present invention.

Solvated bitumen is transferred through line 27 to a holding tank 29. Alcohol-water mixture utilized in the process is stored in holding tank 31. Tank 31 is supplied through line 33 from recycling apparatus to be later described. At least a small quantity of alcohol (typically isopropyl alcohol) will be lost in the process and must be made up. Tank 35 contains the make up alcohol.

A blender 51 has a supply line 49 which is connected to receive solvated bitumen through line 37, alcohol-water through line 41 and makeup alcohol through line 45; pumps 39, 43 and variable delivery pump 47 serve to produce and control the flow of liquids to blender 51.

It will be understood that while pumps are shown in particular locations in the diagram of FIG. 1, it is basically a schematic diagram and actual pump locations and flow line connections would be determined in accordance with conventional techniques of chemical plant design. The same is true of FIG. 2. Neither the number or the location of the pumps illustrated is critical to the design of the apparatus for carrying out the process of the invention.

While tank 31 is designated an alcohol-water tank, in many cases the process will be more effective with brine rather than water being admixed with the alcohol. In other words the water of tank 31 may have and usually will have sodium chloride or a similar salt in solution.

The alcohol content of the alcohol-brine solution fed to blender 51 with the solvated bitumen may be varied by operation of the variable delivery pump 47. Other means of a conventional type may be employed to control the materials proportions for blender 51. Blender 51 is conventional liquid blending apparatus employing mechanical agitation or other suitable mechanism for attaining a homogeneous mixture. A primary phase settler 55 is fed directly from blender 51 through line 53. In settler 55 a phase formation takes place resulting in gravity separation of a lower heavy hydrocarbon phase containing small or insignificant amounts of alcohol, brine, and acid process chemicals. Other means for separating liquids of different density could be used in place of conventional settler 55. The heavy hydrocarbon phase is removed through line 59 and pumped or otherwise transported to product storage tank 61.

The efficiency of the process may be improved if the lower phase in settler tank 55 is heated to from 40° C. to 50° C. or higher temperatures and an optional heater 57 may be employed for that purpose. The upper phase (or phases) of primary settler 55 contains virtually all process constituents except for the bitumen-derived hydrocarbon product and light hydrocarbon diluent, and the remaining upper phase constituents are fed through line 63 by means of pump 65 to a boiler 67. Boiler 67 feeds a condenser 71 through line 69 whereby an alcohol-rich vapor phase is condensed and transported through line 63 by pump 75 to alcohol-water tank 31. In some cases it may be necessary or desirable to replace boiler 67 and condenser 71 with a distillation column of two or more stages for higher concentration of alcohol in line 73.

The liquid phase from boiler 67 is passed into line 77; after being cooled by fan cooler 79 it is delivered by pump 81 to secondary phase settler 83.

After reduction of the alcohol concentration in line 77 phase separation takes place in secondary settler 83 wherein the upper phase is the fatty acid constituent which is delivered through line 89 by pump 91 to fatty acid hold tank 93, where it may be controlled to recycle through line 95 to recycle fatty acid tank 19.

The lower phase in secondary phase settler 83 is an alcohol-brine (or alcohol-water) phase which is recycled through line 87 by pump 85 to the alcohol-water tank 31. It will be seen from the foregoing description that the method and apparatus shown in FIG. 1 provides a recycling of solvents and particularly the fatty acid solvent in a manner which is relatively simple compared to processes involving saponification or other previous processes and is at the same time much less energy intensive than distillation techniques for the separation of fatty acid solvent from the hydrocarbon product. For an illustrative flow rate table, see Table 1.

Figure 2:
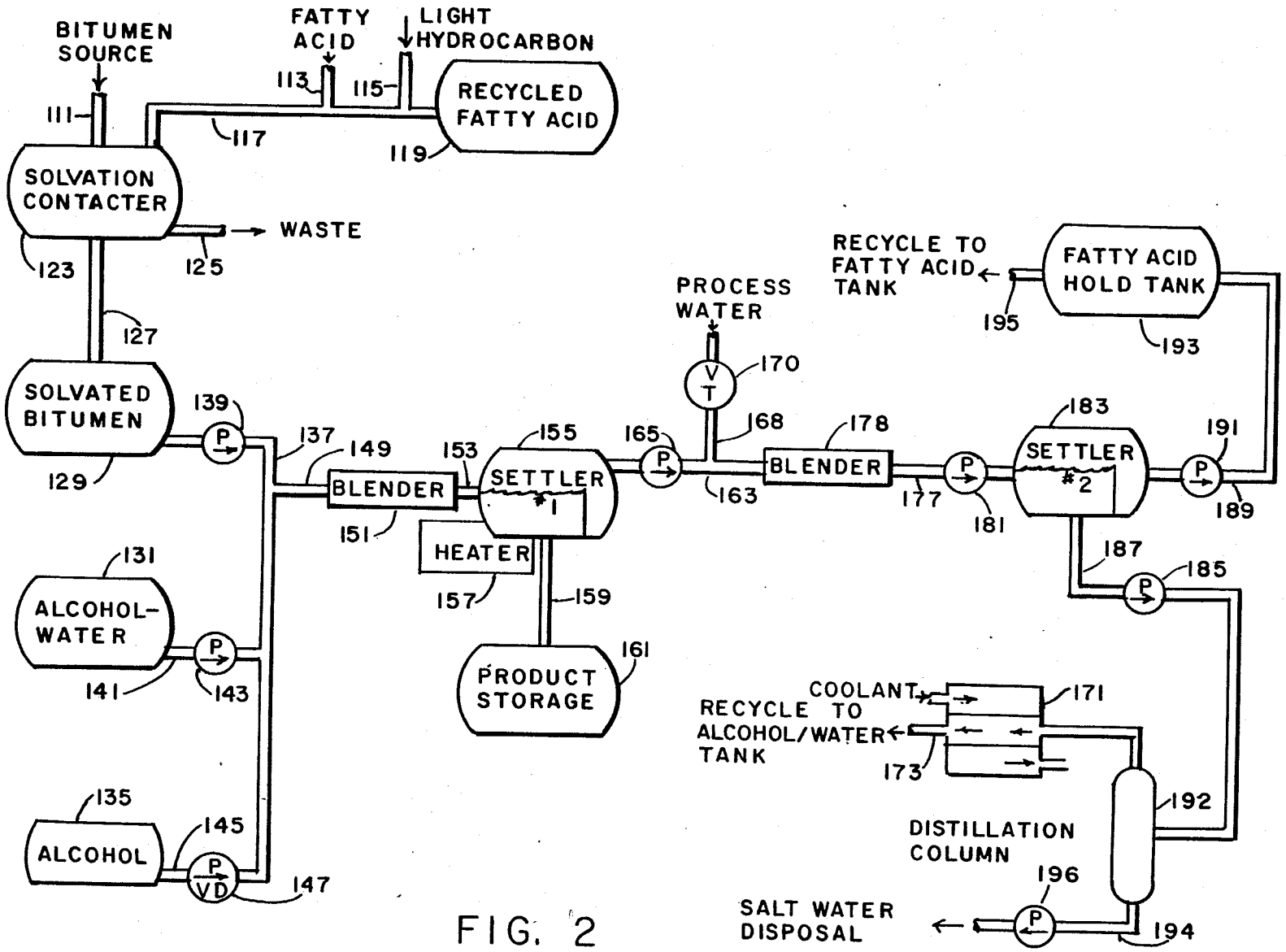
FIG. 2 is a schematic diagram showing an alternative apparatus and process including water overdose phase separation for recovery of recycle acid from the acid-alcohol-water process stream.

The method and apparatus of FIG. 2 is generally similar to that of FIG. 1, and differs primarily in the technique for separating and recycling the fatty acid and the alcohol-water components.

It should be understood that all reference to fatty acid in the drawings and in the description identifies the preferred forms of carboxylic acids for most purposes as presently contemplated. In general these references to fatty acid could be replaced by "carboxylic acids having from 8 to 20 carbon atoms or admixtures thereof". Light hydrocarbons to be employed as an auxiliary diluent may include, but are not limited to, alkanes such as propane, butane, pentane, hexane, and heptane.

In FIG. 2, lines 113 and 115 supply fatty acid and light hydrocarbon solvents to the system while recycled fatty acid is supplied from tank 119 all through line 117 to solvation contactor 123. The bitumen source material is supplied through channel 111 and the outputs from solvation contactor 123 are solvated bitumen through line 127 and sand or other waste material through channel 125.

A mixture of solvated bitumen with alcohol-water (or alcohol-brine) is supplied from tanks 129, 131 and 135 through lines 137, 141 and 145 respectively to input line 149 for blender 151. The liquids are transported under the control of pumps 139, 143 and 147, all as generally described with regard to FIG. 1.

Blender 151 feeds the primary settler 155 through line 153 and an optical heater 157 is provided for the primary settler 155 as previously described. Bitumen-derived product is extracted from the lower phase of settler 155 and fed to product storage 161. Of course further processing of the bitumen-derived product may be carried out with conventional techniques to produce certain desired useful hydrocarbon end products.

An acid-alcohol-water stream is extracted from settler 155 through line 163 and may be transported by a pump 165. The process and apparatus of FIG. 2 employs a technique in the second settling step which takes advantage of further phase separation of the fatty acid from the alcohol-water to remove and recycle the fatty acid (or other carboxylic acid) utilized in the process. For this technique additional process water is added through a throttle valve 170 in line 168 to be combined in blender 178 and fed through line 177 to secondary settler 183. It might be noted that in theory the function of primary settler 155 and settler 183 might be combined in a process of phase separation into three phases consisting of, from top to bottom; carboxylic acid, alcohol-water (or alcohol-brine), and bitumen-derived product. Thus while it would be within the scope of the invention to separate these three distinct phases in one settler apparatus, the practical difficulties thereof make the process utilizing two separate steps of gravity separation preferable in the usual circumstances contemplated.

Pump 181 in input line 177 and pumps 185 and 191 in output lines 187 and 189 from settler 183 perform a usual function of transporting the liquid process chemicals. As explained before, the number, position and character of the pumps utilized is not limited to that shown, but will be determined by conventional process apparatus design techniques for a designated process and apparatus.

As will be seen from the apparatus thus far described, inline mixer or blender 178 together with process water input through line 168 in FIG. 2 replaces boiler 67, condenser 71, and fin-fan cooler 79; thus in FIG. 2 process water is mixed in line 177 before being pumped to secondary settler 183. This achieves the same result as the boiler and condenser, because both processes increase the water content of the stream to the secondary settler to cause shifting in the phase equilibrium in the secondary settler 183. Thus phase separation is effectively produced in settler 183 allowing the fatty acid or carboxylic acid to be drawn off the top phase and recycled.

If water overdosing is used as shown in FIG. 2, then a distillation column 192 is used to recover alcohol in greater concentration from the stream in line 187. A dilute brine waste stream is pumped to disposal through line 194 by means of pump 196 while suitable concentrated alcohol-water is recovered overhead in line 173 after condensation in condenser 171.

The distillation process effected by column 192 is a relatively low energy requirement process particularly if suitable heat recovery techniques are employed. By way of example waste heat may be employed for heater 157 which requires a temperature of only about 50 degrees Celsius.

From the above description of FIG. 2 it will be seen that an alternative separation process for the fatty acid relative to the alcohol water component is provided which may in many cases be more cost effective than that of FIG. 1. In particular it will be seen that the FIG. 2 apparatus and method does not require that the fatty acid component be heated and subsequently cooled as a part of the processing of the recirculating stream of carboxylic acid solvent.

Figure 3:
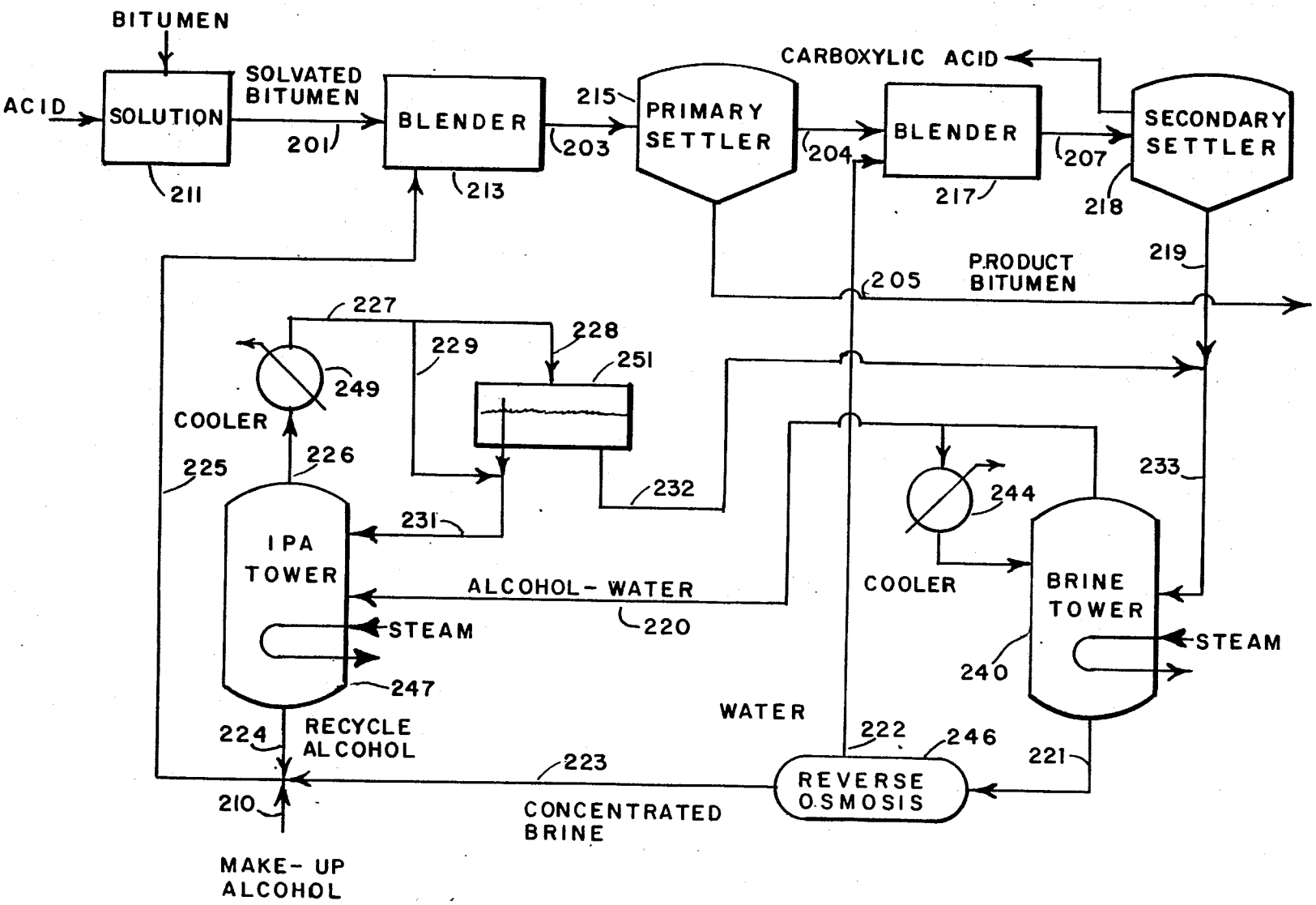
FIG. 3 is a schematic flow chart diagram of a process according to the invention showing more extensive recycling of process chemicals for environmental protection.

FIG. 3 shows a flow diagram of a modification of the process of FIG. 2 which differs primarily in that a series of reverse osmosis units 225 of conventional design are employed to reconcentrate a brine solution for return to initial blender 213.

The added complexity of the process of FIG. 3 achieves a more complete recovery of process chemicals and endeavors to eliminate any chemical waste products or limit them to water or other environmentally innocuous materials. The basic process of FIG. 3 is essentially similar to that shown in FIG. 1 or more specifically that shown in FIG. 2. Namely a carboxylic acid solvated bitumen solution 211 is fed to a blender 213 which is also supplied with an alcohol-brine solution whereupon the composite admixture is transported into a primary settler 215 so that amphiphilic phase separation will permit gravity separation of product bitumen from the lower phase while the brine, alcohol and acid process chemicals are fed to blender 217 which is also supplied with overdosing water from reverse units 225 thereby generating a suitable solution for settling in secondary settler 218.

An upper phase of carboxylic acid is removed from secondary settler 218 while brine and alcohol is supplied to a brine tower 240 including cooler 244 for extracting an (isopropyl) alcohol stream.

In order to balance the flow rates in the process illustrated in FIG. 3 (to minimize or eliminate discharge streams) the alcohol-water stream from brine tower 240 receives further alcohol concentration in IPA tower 247. This brings the alcohol concentration in the recycled alcohol-water stream above the azeotrope concentration of approximately 70 percent by weight alcohol. Tank 251 aids in controlling flow rates, and water therefrom is added to the stream supplying the distillation column of brine tower 240. The IPA Tower 247 and associated apparatus is not a novel feature of the invention and is a known apparatus and procedure shown for example in Buford D. Smith "Design of Equilibrium Stage Processes" Published 1963 by McGraw Hill; Pages 406–409. Understanding of FIG. 3 will be aided by reference to Table II which gives exemplary flow rates for a system such as illustrated in FIG. 3.

From the foregoing explanation it will be seen how selected process steps in conventional or known chemical process apparatus are combined according to the invention for recovering oil or bitumen-derived products in a method which is characterized by the efficient recovery of carboxylic acid and other process chemicals employed in the amphiphilic phase separation procedure.

The following examples of processes according to the invention with specific materials, flow rates, times, temperatures and other parameters should be considered to be illustrative and not restrictive of the scope of the present invention. All proportions stated in the examples are by weight unless otherwise indicated.

EXAMPLE 1

A solvated bitumen solution containing approximately 20 percent by weight of Kentucky bitumen, 8 percent isopropyl alcohol, 24 percent light hydrocarbon solvent such as heptane, and 48 percent tall oil derived fatty acid solvent, such as Xtol 304, is fed to a blender 51 at a rate of 4.1 gpm. An alcohol/brine solution containing 68 percent isopropyl alcohol (2-propanol) and 32 percent 2500 ppm brine solution is simultaneously fed to this blender at a rate of 12.9 gpm. Under these feed conditions the product stream in line 59 from settler 55 produces 520 lb/hr of a bitumen rich product containing 54 percent bitumen, 6 percent isopropyl alcohol, 38 percent heptane, and 2 percent fatty acid. The fatty acid rich solvent recycle stream would produce 1070 lb/hr through line 89 containing 77 percent fatty acid, 7 percent bitumen, and 16 percent heptane. The concentration of alcohol in the alcohol/brine stream as well as the ratio of stream in line 37 to stream in lines 41 and 45 may be varied in order to produce a variation in bitumen product stream 59. The residence times in primary settler 55 and in secondary settler 83 are respectively less than 30 minutes and preferably, approximately 10 minutes. See Table 1 below.

EXAMPLE 2

The procedures are the same as in Example 1, except an admixture of one or more vegetable-derived fatty acids such as soybean oil, cottonseed oil, safflower oil, palm oil, or corn oil is used in place of all or part of the tall oil derived fatty acid. This prevents the hardening of the bitumen product that may occur in some cases because of small amounts of resin present in the tall oil derived fatty acids.

EXAMPLE 3

The procedures are the same as Example 1, except that the alcohol/brine stream through line 49 from tanks 31 and 35 is composed of approximately 85 percent by weight methanol and 15 percent by weight of pure water. The result is a much more fluid bitumen product containing high concentrations of fatty acid. This mode of operation is useful to provide an asphaltic blending stock for road paving. The fatty acid serves as an emulsifier in the paving asphalt.

EXAMPLE 4

The procedures are the same as Example 1, except the alcohol/brine stream is an admixture of at least 10 percent of two different forms of alcohol containing methanol, ethanol, 1-propanol, 2-propanol, and/or butanol, to meet specified bitumen-derived product composition and characteristics. The exact admixture composition varies depending upon differences in chemical composition of the feedstock bitumen and the amount of bitumen in the feedstock stream.

EXAMPLE 5

The procedures are the same as in a selected one of Examples, 1 to 4, except at least the bottom phase in primary settler 55 is heated to 40°-50° C. resulting in a purer bitumen product in some instances.

EXAMPLE 6

The procedures are the same as Example 5, except the bottom phae in primary settler 108 is heated to 90°-110° C. or greater to achieve a granular, solid bitumen product upon cooling. This product may be suitable for production of carbon black.

EXAMPLE 7

The procedures are the same as Example 1, except the brine concentration in the alcohol/brine stream is varied from 0 percent to 10 percent depending upon the bitumen feedstock properties to achieve a bitumen product containing a predetermined desired amount of fatty acid to serve as an emulsifier or for other purposes. It is also possible in some cases to achieve desired product characteristics by varying the ratio of the alcohol/-brine stream to the solvated bitumen stream between the ratios of 1:1 to 5:1.

EXAMPLE 8

The procedures are the same as a selected one of Examples 1 to 7 except the residence time in primary settler 108 and secondary settler 109 is varied between 1 and 10 minutes in order to vary the composition of the product bitumen stream.

EXAMPLE 9

The procedures are the same as a selected one of Examples 1 to 8 except the procedure of water overdosing as shown in FIG. 2 is used to achieve phase equilibrium shift in secondary settler 183, and subsequent distillation is used to recover the alcohol. A dilute brine stream is discharged to salt water disposal.

EXAMPLE 10

The procedures are the same as Example 9 except reverse osmosis and a two distillation column system are used to recover both the alcohol and the brine, thereby substantially eliminating all discharge streams. FIG. 3 shows the process flow diagram for this example, and Table 2 represents the process stream mass balance for a 336 barrel/day demonstration plant. For illustrative purposes, the product bitumen stream, line 5, was assumed to be pure bitumen in the calculations shown in Table 2.

EXAMPLE 11

The procedures are the same as Examples 1, 3, 4 or 5-8 except the Xtol 304 solvent is replaced by commercial oleic acid.

EXAMPLE 12

The procedures are the same as Examples 1, 3, 4 or 5-8 except the Xtol 304 solvent is replaced by dithiobenzoic acid.

EXAMPLE 13

A solvated bitumen solution containing approximately 10-20 percent Fitzgerald (Oklahoma) tar sand, 5-10 percent isopropyl alcohol, 20-25 percent light hydrocarbon solvent such as heptane, and 40-60 percent acid solvent formed of an admixture of one or more of the vegetable-derived fatty acids consisting of soybean oil, cottonseed oil, safflower oil, palm oil, and corn oil, is fed to inline blender 51 or 151 at a rate of 4-5 gpm. An alcohol/brine solution containing 60-80 percent isopropyl alcohol (2-propanol) and 1000-3000 ppm brine solution is simultaneously fed to this blender at a rate of 10-15 gpm. The concentration of alcohol in the alcohol/brine stream as well as the ratio of such stream to the feedstock stream may be varied in order to produce a variation in bitumen product. The residence times in primary settler 108 and in secondary settler 112 are respectively approximately 5 to 15 minutes.

EXAMPLE 14

The procedures are the same as Example 13, except the alcohol/brine stream is an admixture of 2 or more alcohols containing methanol, ethanol, 1-propanol, 2-propanol, and/or butanol, to meet specified product composition and characteristics. The exact admixture composition is varied depending upon differences in chemical composition of the feedstock bitumen and the amount of bitumen in the feedstock.

EXAMPLE 15

The procedures are the same as in a selected one of Examples 12-14, except the bottom phase in primary settler 55 is heated to 40°-50° C.

EXAMPLE 16

The procedures are the same as Example 13, except the brine concentration in the alcohol/brine stream is varied from 0 percent to 10 percent depending upon the bitumen feedstock properties to achieve a bitumen product containing varying amounts of fatty acid as may be desirable in some cases.

EXAMPLE 17

A solvated bitumen solution containing approximately 20 percent by weight of Kentucky bitumen, 8 percent isopropyl alcohol, 24 percent light hydrocarbon solvent such as heptane, and 48 percent carboxylic acid solvent, such as dithiobenzoic acid, is fed to a blender at a rate of 4.1 gpm. An alcohol/brine solution containing 68 percent isopropyl alcohol (2-propanol) and 32 percent 2500 ppm brine solution is simultaneously fed this blender at a rate of 12.9 gpm. The concentration of alcohol in the alcohol/brine stream as well as the ratio of stream in line 37 to stream in lines 41 and 45 may be varied in order to produce a variation in bitumen product stream 59. The residence times in primary settler 55 and in secondary settler 83 are respectively less than 30 minutes and preferably, approximately 10 minutes.

The above examples are illustrative only, and those skilled in the art will appreciate that there are numerous variations which can be employed in virtually innumerable combinations. While tar sands have been specified as bitumen source material because of their potential economic importance, other bitumen source materials could be substituted, with adjustment of process parameters in some cases.

Various fatty acids have been enumerated in the examples, but there is a wider range of carboxylic acids (generally those having 8 to 20 carbon atoms) among which selection may be made based on contemporaneous price and availability or other factors.

Potential carboxylic acids for use in the process include but are not limited to the following:

mono and/or polyalkanoic acid, alkenediolic acid, alkenoic acid, alpha linoleic acid, aracadonic acid, arachidic acid, benzilic acid, bethinic acid, dithiobenzoic acid, gamma linoleic acid, hydroxyalkanoic acid, lauric acid, lignoceric acid, linoleic acid, linolenic acid, myristic acid, naphthenic acid, octadecenoic acid, oleic acid, palmitic acid, petroselaidic acid, stearic acid, tetranoic acid, thiocarboxylic acid, and/or truenoic acid.

In the same vein, alcohols for use in the process may be selected as much on the basis of current cost and availability as on other factors. Similarly, brine when referred to above is contemplated to be a solution of water and predominantly sodium chloride, but the process is not limited to sodium chloride as the brine component, and in fact, the brine component may be omitted in some cases.

While the above described theory of operation of the process is thought to be responsible for the observed efficient separation and recovery of carboxylic acids and other advantages of the invention, the novelty and advantages of the process are not attributable to the theory presented but are due to actual results established by experimentation. Accordingly, patentability of the invention is not to be considered to be dependent on the theory presented above, although any theory presented, so far as it is known, is believed to be correct. The steps recited in the claims may in some cases be performed in a different sequence than the sequence in which they are listed, or steps may be performed concurrently.

In addition to the variations and modifications to the invention which have been described or suggested, numerous other variations or modifications will be apparent to those skilled in the art. Accordingly the scope of the invention is not to be considered to be limited to the embodiments and variations described but is to be determined by reference to the appended claims.

TABLE 1

MASS BALANCE FOR 25 BPD PILOT PLANT (stream flows in lb/hr.)

| Component | Density | GPM | Heptane | Fatty Acid | Bitumen | Alcohol | Water | Salt | Total |
|---|---|---|---|---|---|---|---|---|---|
| 1. Stream 37 | 0.858 | 4.07 | 420.00 | 840.00 | 350.00 | 140.00 | 0.0 | 0.0 | 1750.00 |
| 2. Stream 41,45 | 0.862 | 12.93 | 136.49 | 208.72 | 0.0 | 3675.00 | 1571.06 | 3.94 | 5577.41 |
| 3. Stream 53 | 0.859 | 17.08 | 556.49 | 1048.72 | 350.00 | 3815.00 | 1571.06 | 3.94 | 7345.20 |
| 4. Stream 63 | 0.856 | 16.02 | 420.00 | 1041.87 | 35.00 | 3794.45 | 1571.06 | 3.94 | 6866.31 |
| 5. Stream 59 | 0.900 | 1.06 | 136.49 | 6.85 | 315.00 | 20.54 | 0.0 | 0.0 | 478.88 |
| 6. Stream 73 | 0.836 | 5.70 | 136.49 | 0.0 | 0.0 | 1764.32 | 483.49 | 0.0 | 2387.05 |
| 7. Stream 77 | 0.866 | 10.34 | 283.51 | 1041.87 | 35.00 | 2030.13 | 1087.58 | 3.94 | 4482.02 |
| 8. Stream 89 | 0.842 | 3.06 | 283.51 | 833.15 | 35.00 | 140.00 | 0.0 | 0.0 | 1291.66 |
| 9. Stream 87 | 0.876 | 7.28 | 0.0 | 208.72 | 0.0 | 1890.13 | 1087.58 | 3.94 | 3190.36 |
| 10. Stream 45 | 0.804 | 0.05 | 0.0 | 0.0 | 0.0 | 20.54 | 0.0 | 0.0 | 20.54 |

TABLE 2

BASIS: 336 bbL/day PRODUCT BITUMEN

| | STREAM TONS/DAY | | | | | | | | | | |
|---|---|---|---|---|---|---|---|---|---|---|---|
| COMPONENT | 201 | 203 | 205 | 204 | 207 | 208 | 219 | 220 | 221 | 222 | 223 |
| FATTY ACID | 231 | 231 | — | 231 | 231 | 231 | — | — | — | — | — |
| HEPTANE | 114.5 | 114.5 | — | 114.5 | 114.5 | 114.5 | — | — | — | — | — |
| 2-PROPANOL | 56.3 | 982.9 | — | 982.9 | 982.9 | 57 | 929.9 | 1009.1 | — | — | — |
| BITUMEN | 58.9 | 58.9 | 58.9 | — | — | — | — | — | — | — | — |
| SALT (NaCl) | — | 1.1 | — | 1.1 | 1.1 | — | 1.1 | — | 1.1 | — | 1.1 |
| WATER | — | 455.3 | — | 455.3 | 4024.9 | — | 4024.9 | 124.2 | 4024.9 | 3569.6 | 455.3 |
| CYCLOHEXANE | — | — | — | — | — | — | — | 5.6 | — | — | — |
| TOTAL | 460.7 | 1843.7 | 58.9 | 1784.8 | 5354.4 | 402.5 | 4955.9 | 1138.9 | 4026 | 3569.6 | 456.4 |

| | STREAM TONS/DAY | | | | | | | | | | |
|---|---|---|---|---|---|---|---|---|---|---|---|
| COMPONENT | 224 | 225 | 226 | 227 | 228 | 229 | 230 | 231 | 232 | 233 | 210 |

TABLE 2-continued

| BASIS: 336 bbL/day PRODUCT BITUMEN | | | | | | | | | | | |
|---|---|---|---|---|---|---|---|---|---|---|---|
| FATTY ACID | — | — | — | — | — | — | — | — | — | — | — |
| HEPTANE | — | — | — | — | — | — | — | — | — | — | — |
| 2-PROPANOL | 925.8 | 926.6 | 405.2 | 405.2 | 315.6 | 89.5 | 232.5 | 322 | 83.2 | 1009.1 | 0.8 |
| BITUMEN | — | — | — | — | — | — | — | — | — | — | — |
| SALT (NaCl) | — | 1.1 | — | — | — | — | — | — | — | 1.1 | — |
| WATER | — | 455.3 | 171.6 | 171.6 | 127 | 36 | 11.4 | 47.4 | 124.2 | 4149.1 | — |
| CYCLOHEXANE | — | — | 1587.8 | 1587.8 | 1243.8 | 352.8 | 1229.4 | 1582.2 | 5.6 | 5.6 | — |
| TOTAL | 925.8 | 1383 | 2164.6 | 2164.6 | 1686.4 | 478.3 | 1473.3 | 1951.6 | 213 | 5164.9 | 0.8 |

We claim:

1. A method for recovering crude oil from fossil fuel deposits of heavy oil or bitumen comprising the steps of:

(a) exposing an admixture containing at least one carboxylic acid to a viscous or solid crude oil source material;

(b) intimately contacting said carboxylic acid admixture with respect to the source material to produce a solvated crude oil mixture of reduced viscosity;

(c) blending the solvated crude oil mixture with an alcohol-water solution to produce an amphiphilic phase separation of the resulting mixture;

(d) gravity separating the resulting mixture in a settling chamber by extracting an alcohol-water-acid phase from the top of said chamber;

(e) distilling said alcohol-water-acid phase to at least partially separate said carboxylic acid from said alcohol-water solution;

(f) further gravity separating the acid component output from said distilling step to produce recovered carboxylic acid with reduced water and alcohol content;

(g) recycling the recovered carboxylic acid into step (a); and (h) recycling recovered alcohol-water solution into step (c).

2. The method as recited in claim 1 wherein said carboxylic acid admixture is selected from the group consisting of; lauric acid; myristic acid; palmitic acid; stearic acid; arachidic acid; bethinic acid; lignoceric acid; mono and/or poly alkanoic acid; hydroxyalkanoic acid; alkenediolic acid; alkenoic acids; linoleic acid; truenoic acids; and tetranoic acids.

3. The method as recited in claim 2 wherein said alkanoic acids are selected from the group consisting of oleic acid, petroselaidic acid and octadecenoic acid.

4. The method as recited in claim 2 wherein said truenoic acids are selected from the group consisting of alpha linoleic and gammalinoleic acid.

5. The method as recited in claim 2 wherein said tetranoic acids include aracadonic acid.

6. The method as recited in claim 1 wherein said alcohol-water solution of step (c) has a brine component.

7. The method as recited in claim 6 wherein the brine component comprises sodium chloride.

8. The method as recited in claim 1 wherein said carboxylic admixture also contains alkane, lower alcohols, and aromatic solvents selected from the group consisting of pentane, hexane, heptane, toluene, benzene, methanol, ethanol, isopropanol, methylene chloride, and light petroleum distillates.

9. The method as recited in claim 1 wherein said carboxylic acid admixture consists of at least one carboxylic acid with molecules having between 8 and 20 carbon atoms.

10. A method for recovering crude oil from fossil fuel deposits of heavy oil or bitumen comprising the steps of:

(a) exposing an admixture containing at least one carboxylic acid having 8 to 20 carbon atoms to a viscous or solid crude oil source material;

(b) contacting said carboxylic acid admixture with respect to the source material for a time sufficient to produce a solvated crude oil mixture of reduced viscosity;

(c) blending the solvated crude oil mixture of step (b) with an alcohol-water solution to produce phase separation of the resulting mixture;

(d) gravity separating the resulting liquid of step (c) by extracting an alcohol-water-acid phase of lesser density from the liquid;

(e) separating said carboxylic acid from said alcohol-water-acid solution;

(f) recycling the recovered carboxylic acid into step (a); and (g) recycling recovered alcohol-water solution into step (c).

11. The method as recited in claim 10 wherein said alcohol-water solution of step (c) has a brine component.

12. The method as recited in claim 11 wherein the brine component comprises sodium chloride.

13. The method as recited in claim 10 wherein said carboxylic acid is selected from the group consisting of benzilic acid, dithiobenzoic acid, linoleic acid, linolenic acid, myristic acid, naphthenic acid, oleic acid, palmitic acid, stearic acid, and thiocarboxylic acids.

14. The method as recited in claim 10 wherein said alcohol is predominately methanol.

15. The method as recited in claim 10 wherein said alcohol is predominately isopropanol.

16. The method as recited in claim 10 further including a step of mixing a light hydrocarbon with said carboxylic acid admixture prior to step (c).

17. The method as recited in claim 16 wherein said light hydrocarbon is heptane.

18. The method as recited in claim 10 further including the step of heating the solvated crude oil mixture of step (b) to a temperature of at least 40 degrees Celsius.

19. The method as recited in claim 10 further including the step of decreasing the concentration of alcohol in said alcohol-water solution before step (e).

20. The method as recited in claim 19 further including the step of heating the solvated crude oil mixture of step (b) to a temperature of at least 40 degrees Celsius.

21. The method as recited in claim 10 wherein step (e) is accomplished at least in part by injecting process water to overdose the solution and shift the phase equilibrium to enable gravity separation of said acid.

22. The method as recited in claim 21 wherein said carboxylic acid admixture is selected from the group consisting of: lauric acid; myristic acid; palmitic acid; stearic acid; arachidic acid; bethinic acid; lignoceric acid; mono and/or poly alkanoic acid; hydroxyalkanoic acid; alkenediolic acid; alkenoic acids; linoleic acid; truenoic acids; and tetranoic acids.

23. The method as recited in claim 22 wherein said truenoic acids are selected from the group consisting of alpha linoleic and gamma linoleic acid.

24. The method as recited in claim 22 wherein said tetranoic acids include aracadonic acid.

25. The method as recited in claim 10 wherein said alcohol-water solution of step (c) has a brine component.

26. The method as recited in claim 25 wherein the brine component comprises sodium chloride.

27. The method as recited in claim 10 wherein said carboxylic acid consists of at least two carboxylic acids each with molecules having between 8 and 20 atoms.

28. A method for recovering oil from viscous or solid oil source material comprising the steps of:

(a) exposing an admixture containing at least one of the carboxylic acids to said viscous or solid oil source material to produce a solvated oil mixture of reduced viscosity;

(b) blending the solvated crude oil mixture with an alcohol to produce phase separation of the resulting mixture;

(c) separating the resulting mixture from step (b) into different density components including one alcohol-acid component;

(d) further separating an acid component from said alcohol-acid component to produce recovered carboxylic acid with reduced alcohol content;

(e) recycling the recovered carboxylic acid into step (a); and (f) recycling recovered alcohol solution into step (b).

29. The method as recited in claim 28 wherein said carboxylic acid is selected from the group consisting of myristic acid; palmitic acid; stearic acid, linoleic acid; and oleic acid.

30. The method as recited in claim 28 wherein said carboxylic acids are alkanoic acids selected from the group consisting of oleic acid, petroselaidic acid and octadecenoic acid.

31. The method as recited in claim 28 wherein said carboxylic acids are truenoic acids selected from the group consisting of alpha linoleic acid and gammalinoleic acid.

32. The method as recited in claim 28 wherein said carboxylic acids include aracadonic acid.

33. The method as recited in claim 28 wherein said alcohol-water solution of step (c) has a brine component.

34. The method as recited in claim 33 wherein the brine component comprises sodium chloride.

35. The method as recited in claim 28 wherein said carboxylic admixture also contains alkane, lower alcohols, and aromatic solvents selected from the group consisting of pentane, hexane, heptane, toluene, benzene, methanol, ethanol, isopropanol, methylene chloride, and light petroleum distillates.

36. The method as recited in claim 28 wherein said carboxylic acid admixture consists of at least one carboxylic acid with molecules having between 8 and 20 atoms.

37. The method as recited in claim 28 wherein said carboxylic acid is selected from the group consisting of benzilic acid, dithiobenzoic acid, linoleic acid, linolenic acid, myristic acid, naphthenic acid, oleic acid, palmitic acid, stearic acid, and thiocarboxylic acids.

38. The method as recited in claim 28 wherein said alcohol is predominantly isopropanol.

39. The method as recited in claim 28 further including the step of heating the solvated oil mixture of step (a) to a temperature of at least 40 degrees Celsius.

40. The method as recited in claim 28 further including the step of decreasing the concentration of alcohol in said alcohol-water solution before step (d).

41. The method as recited in claim 28 wherein step (d) is accomplished at least in part by injecting process water to overdose the solution and shift the phase equilibrium to enable gravity separation of said acid.

* * * * *